US011602203B1

(12) United States Patent
Serrell

(10) Patent No.: US 11,602,203 B1
(45) Date of Patent: Mar. 14, 2023

(54) WIND-RESISTANT UMBRELLA COMPRISING A PLURALITY OF SHINGLES

(71) Applicant: David C. Serrell, North Myrtle Beach, SC (US)

(72) Inventor: David C. Serrell, North Myrtle Beach, SC (US)

( * ) Notice: Subject to any disclaimer, the term of this patent is extended or adjusted under 35 U.S.C. 154(b) by 0 days.

(21) Appl. No.: 17/991,916

(22) Filed: Nov. 22, 2022

(51) Int. Cl.
*A45B 25/22* (2006.01)
*A45B 25/18* (2006.01)
*A45B 23/00* (2006.01)

(52) U.S. Cl.
CPC ..... *A45B 25/22* (2013.01); *A45B 23/00* (2013.01); *A45B 25/18* (2013.01); *A45B 2023/0012* (2013.01)

(58) Field of Classification Search
CPC ..... A45B 25/22
See application file for complete search history.

(56) References Cited

U.S. PATENT DOCUMENTS 4,804,008 A * 2/1989 Ryder ..... A45B 25/22 135/33.7
5,305,770 A * 4/1994 DeMarco ..... A45B 25/02 135/31
6,038,820 A * 3/2000 Rainbolt ..... E06B 9/24 52/63
6,233,881 B1 * 5/2001 Rainbolt ..... E04H 15/54 52/173.3
6,802,325 B1 * 10/2004 Apple ..... A45B 25/18 135/98
8,020,572 B2 * 9/2011 Ma ..... A45B 25/02 135/33.7
9,392,852 B1 * 7/2016 Houston ..... A45B 23/00
2006/0191563 A1 * 8/2006 Goodman ..... A45B 25/18 135/15.1
2010/0258151 A1 * 10/2010 Vogt ..... A45B 25/20 135/33.7

FOREIGN PATENT DOCUMENTS

FR 2932837 A1 * 12/2009 ..... A45B 25/22

* cited by examiner

*Primary Examiner* — Noah Chandler Hawk
(74) *Attorney, Agent, or Firm* — Ashley D. Johnson; Dogwood Patent and Trademark Law

(57) ABSTRACT

The invention is directed to an umbrella comprising a plurality of shingles attached to a webbed or mesh support. The umbrella includes a plurality of shingles attached in an overlapped orientation to a lower mesh layer. Each shingle is supported by a pair of grommets to prevent the shingles from moving and/or rotating in response to the wind. The shingles and mesh arrangement allow air to be vented through the umbrella canopy. As a result, the umbrella effectively resists wind and air gusts that commonly cause conventional umbrellas to be uprooted from the sand and/or damaged.

20 Claims, 9 Drawing Sheets

Fig. 5a
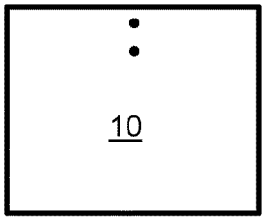
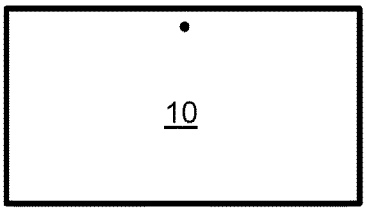
Fig. 5b
Fig. 5c
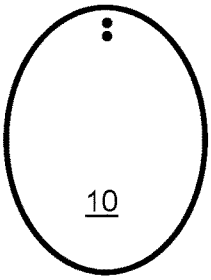
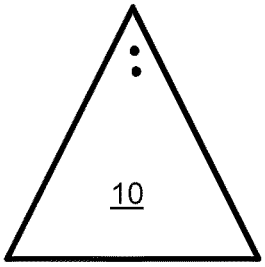
Fig. 5d
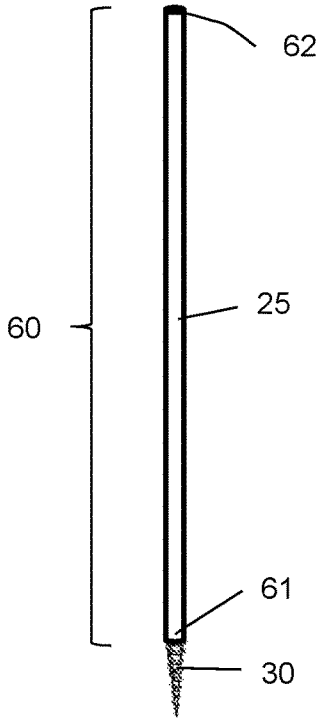
Fig. 6

WIND-RESISTANT UMBRELLA COMPRISING A PLURALITY OF SHINGLES

TECHNICAL FIELD

The presently disclosed subject matter is generally directed to a wind-resistant umbrella comprising a mesh layer and a series of shingles that effectively dissipates wind gusts, providing for safe use.

BACKGROUND

Beach umbrellas are used to create an area shaded from the sunlight beneath the umbrella canopy. Umbrellas are particularly useful at the beach where there is generally a lack of trees or roofed structures to provide shade. Because the skin of the beachgoer is largely exposed at the beach, there is a greater need to provide protection from harmful ultraviolet rays, which may cause sunburn or melanomas. Many beachgoers also require some form of shade to minimize heat discomfort. The shade and shelter provided by a beach umbrella is also useful in protecting the user's valuables and shielding perishable items from direct sunlight. Conventional beach umbrellas include a single central support pole with a pointed lower end that is inserted directly into the sand. Conventional umbrellas further include a bell-shaped canopy via a framework comprising a series of expanding ribs.

However, because beach umbrellas are light, and the canopy has a large surface area, a gust of wind or a relatively light breeze can generate a lifting force and pull the umbrella pole out of the ground. As a result, the beach umbrella is no longer secure, and can easily be lifted out of the sand and blow away, causing serious injury to other beachgoers and damage to property. To this end, every year there are injuries and even deaths associated with beach umbrella accidents, most of which are caused by beach umbrellas dislodging from sand due to high-speed winds.

Attempts have been made to reduce the effects of wind gusts on beach umbrellas. For example, beach umbrellas equipped with a small venting canopy fixed on top of a larger, main canopy have been developed. Such a system works with low-speed winds below about 15 mph but fails when wind gusts are increased. Screw-in augers have also been used to bury the umbrella support pole in the sand in an effort to resist wind gusts. Nonetheless, strong wind gusts in excess of about 20 mph can exceed the strength of the auger, dislodging the beach umbrella from the sand with little or no warning. Wind tunnel testing of conventional umbrellas shows that conventional umbrellas cannot resist repeated or sustained wind gusts in excess of about 20 mph without dislodging or becoming otherwise unusable.

Accordingly, it would be beneficial to provide a wind-resistant umbrella for dissipating wind gusts to preclude the umbrella from being dislodged from its position and being blown down the beach, thereby ensuring a safe beach environment.

SUMMARY

In some embodiments, the presently disclosed subject matter is directed to a wind-resistant umbrella defined by a vertical support pole. The umbrella further includes a canopy attached to an upper end of the support pole. The canopy comprises a lower mesh layer defined by an upper surface and an opposed lower surface, and an upper layer comprising a plurality of shingles, wherein each shingle is defined by an upper surface, an opposed lower surface positioned adjacent to the mesh layer upper surface, and one or more apertures positioned adjacent to a top shingle edge. The canopy also includes a plurality of upper grommets, each upper grommet comprising a lower surface defined by one or more arms that extend away from the lower surface, wherein the lower surface of each upper grommet is positioned adjacent to the upper surface of a shingle and wherein the one or more upper grommet arms extend through the one or more shingle apertures. The canopy further includes a plurality of lower grommets, each lower grommet comprising a top surface and an opposed bottom surface, and one or more openings sized and shaped to accept the one or more arms to join a corresponding upper grommet to the lower grommet, wherein the top surface of each lower grommet is posited adjacent to the mesh layer lower surface. The top edge of each shingle is adhered in position on the umbrella through the upper and lower grommets; and a bottom edge of each shingle is non-adhered to the umbrella and freely moves in an upward direction in response to air currents.

In some embodiments, the shingles are arranged in the upper layer in an overlapped configuration whereby one shingle partially covers at least one other shingle.

In some embodiments, the umbrella further includes a top cap positioned at the top end of the support pole, above the shingles.

In some embodiments, each shingle comprises two apertures positioned at the top edge of the shingle.

In some embodiments, each arm releasably attaches to a corresponding opening.

In some embodiments, each shingle has a length, width, or both of about 3-10 inches.

In some embodiments, the shingles are constructed from a flexible material.

In some embodiments, the shingles are constructed from one or more waterproof materials.

In some embodiments, the umbrella includes an anchor positioned at a second end of the support pole.

In some embodiments, the umbrella comprises a support frame positioned below the mesh layer.

In some embodiments, the frame is defined by a plurality of ribs, cross-ribs, or both.

In some embodiments, the presently disclosed subject matter is directed to a method of precluding dislodgment of a wind-resistant umbrella from an anchoring location. Specifically, the method comprises positioning a wind-resistant umbrella in the anchoring location (e.g., the lower support pole end in the ground, in the sand, etc.). The wind-resistant umbrella is defined as a vertical support pole and a canopy attached to an upper end of the support pole. The canopy comprises: a lower mesh layer defined by an upper surface and an opposed lower surface; an upper layer comprising a plurality of shingles, wherein each shingle is defined by an upper surface, an opposed lower surface positioned adjacent to the mesh layer upper surface, and one or more apertures positioned adjacent to a top shingle edge; a plurality of upper grommets, each upper grommet comprising a lower surface defined by one or more arms that extend away from the lower surface, wherein the lower surface of each upper grommet is positioned adjacent to the upper surface of a shingle and wherein the one or more upper grommet arms extend through the one or more shingle apertures; a plurality of lower grommets, each lower grommet comprising a top surface and an opposed bottom surface, and one or more openings sized and shaped to accept the one or more arms to join a corresponding upper grommet to the lower grommet, wherein the top surface of each lower grommet is posited adjacent to the mesh layer lower surface. The top edge of each shingle is adhered in position on the umbrella through the upper and lower grommets; and a bottom edge of each shingle is non-adhered to the umbrella and freely moves in an upward direction in response to air currents. The method includes exposing the wind-resistant umbrella to windy conditions, such that air freely flows from the lower side of the mesh layer, through the mesh layer, to push against the bottom edge of one or more shingles, thereby moving the bottom shingle edges to create an exit for the air, wherein the wind-resistant umbrella is precluded from dislodging from the anchoring location.

In some embodiments, the bottom edge of the shingles returns to contact the mesh layer when the air flow is removed.

BRIEF DESCRIPTION OF THE DRAWINGS

FIGS. 5*a*-5*d* are top plan views of shingles in accordance with some embodiments of the presently disclosed subject matter.

FIG. 6 is a front plan view of an umbrella post in accordance with some embodiments of the presently disclosed subject matter.

DETAILED DESCRIPTION

Figure 1:
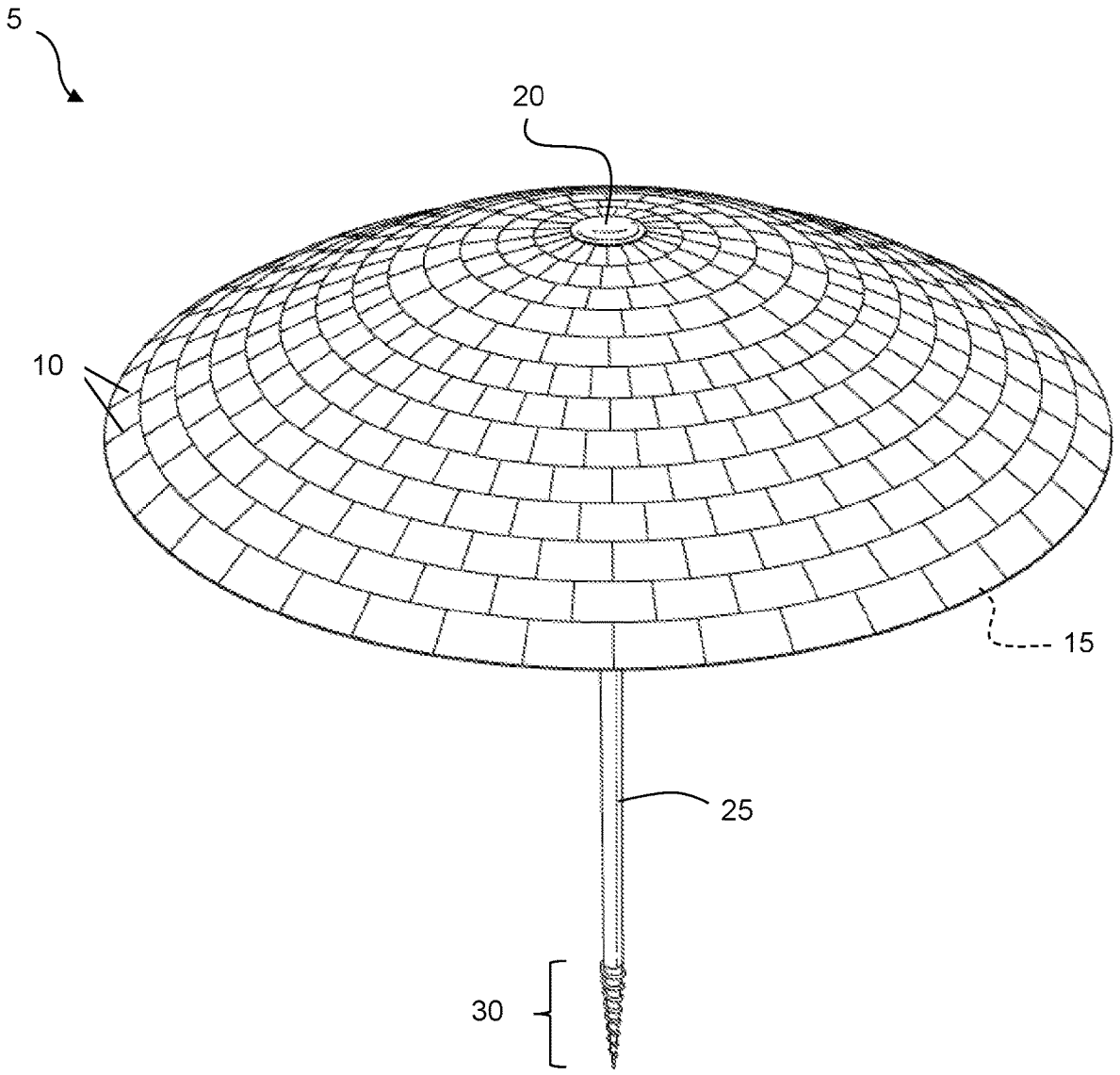
FIG. 1 is a perspective view of a wind-resistant umbrella in accordance with some embodiments of the presently disclosed subject matter.

The presently disclosed subject matter is introduced with sufficient details to provide an understanding of one or more particular embodiments of broader inventive subject matters. The descriptions expound upon and exemplify features of those embodiments without limiting the inventive subject matters to the explicitly described embodiments and features. Considerations in view of these descriptions will likely give rise to additional and similar embodiments and features without departing from the scope of the presently disclosed subject matter.

Unless defined otherwise, all technical and scientific terms used herein have the same meaning as commonly understood to one of ordinary skill in the art to which the presently disclosed subject matter pertains. Although any methods, devices, and materials similar or equivalent to those described herein can be used in the practice or testing of the presently disclosed subject matter, representative methods, devices, and materials are now described.

Following long-standing patent law convention, the terms "a", "an", and "the" refer to "one or more" when used in the subject specification, including the claims. Thus, for example, reference to "a device" can include a plurality of such devices, and so forth. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise indicated, all numbers expressing quantities of components, conditions, and so forth used in the specification and claims are to be understood as being modified in all instances by the term "about". Accordingly, unless indicated to the contrary, the numerical parameters set forth in the instant specification and attached claims are approximations that can vary depending upon the desired properties sought to be obtained by the presently disclosed subject matter.

As used herein, the term "about", when referring to a value or to an amount of mass, weight, time, volume, concentration, and/or percentage can encompass variations of, in some embodiments +/−20%, in some embodiments +/−10%, in some embodiments +/−5%, in some embodiments +/−1%, in some embodiments +/−0.5%, and in some embodiments +/−0.1%, from the specified amount, as such variations are appropriate in the disclosed packages and methods.

As used herein, the term "and/or" includes any and all combinations of one or more of the associated listed items.

Relative terms such as "below" or "above" or "upper" or "lower" or "horizontal" or "vertical" may be used herein to describe a relationship of one element, layer, or region to another element, layer, or region as illustrated in the drawing figures. It will be understood that these terms and those discussed above are intended to encompass different orientations of the device in addition to the orientation depicted in the drawing figures.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

The presently disclosed subject matter is generally directed to an umbrella comprising a plurality of shingles attached to a webbed or mesh support. As shown in FIG. 1, umbrella 5 includes a plurality of shingles 10 attached in an overlapped orientation to lower mesh layer 15. Each shingle is supported by a pair of grommets to prevent the shingles from moving and/or rotating in response to the wind, as discussed in detail below. Umbrella 5 further includes top cap 20 to secure the device. Post 25 provides height to the umbrella and can include anchor 30 that allows the umbrella to be secured into a support surface (e.g., sand). The shingles and mesh arrangement allow air to be vented through the umbrella canopy. As a result, umbrella 5 effectively resists wind and air gusts that commonly cause conventional umbrellas to be uprooted from the sand and/or damaged.

Figure 2A:
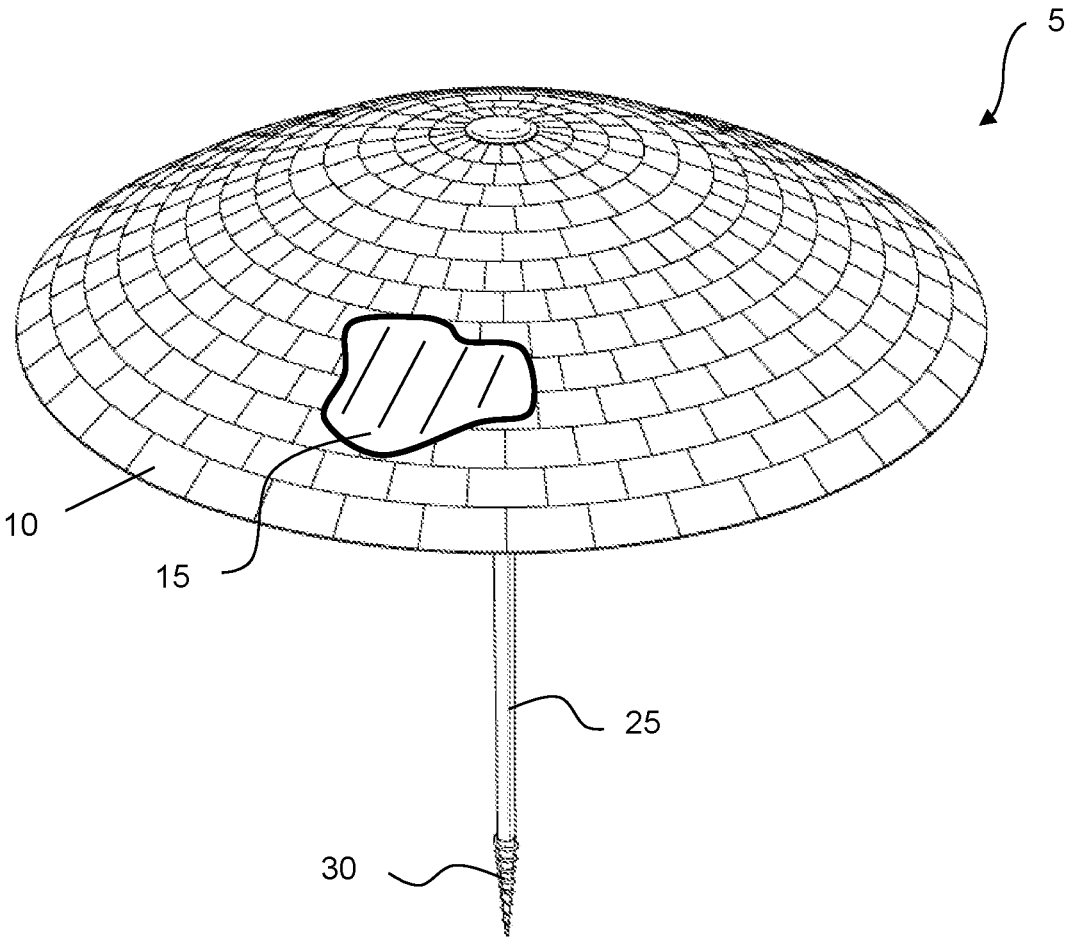
FIG. 2*a* is a perspective view of a wind-resistant umbrella illustrating a lower mesh layer in accordance with some embodiments of the presently disclosed subject matter.
Figure 2B:
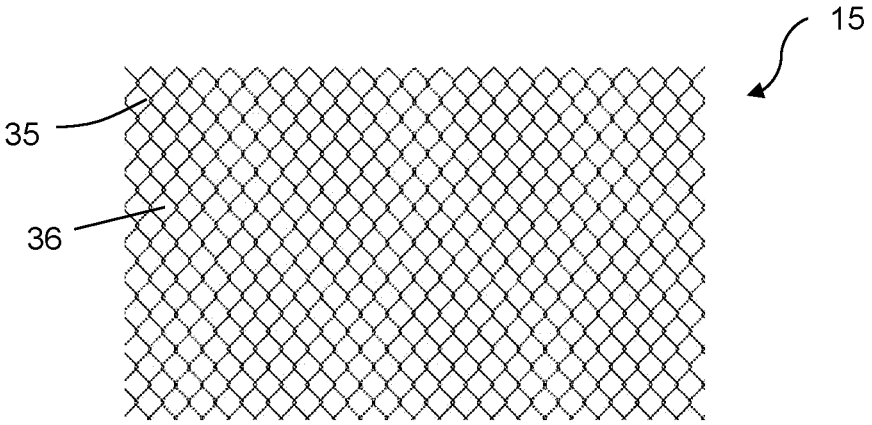
FIG. 2*b* is a top plan view of a portion of mesh layer in accordance with some embodiments of the presently disclosed subject matter.

As shown in the cutaway view of FIG. 2*a*, umbrella 5 includes a dual-layer canopy defined by lower mesh layer 15 and an upper shingle layer positioned beneath the mesh layer. The term "mesh" refers to as structural arrangement of material(s) 35 and includes woven and nonwoven webs or screens, porous solids, a matrix of wires, filaments, strands, fibers, or particles, or any suitable material that provides a mechanically compliant structure with openings 36, as shown in FIG. 2*b*. The mesh can be formed using any suitable method, such as by knitting existing fibers together, weaving, lacing, entangling, and or adhering one or more materials together. Openings 36 can be configured in any desired shape (round, oval, square, triangular, etc.) and/or any suitable size.

Figure 2C:
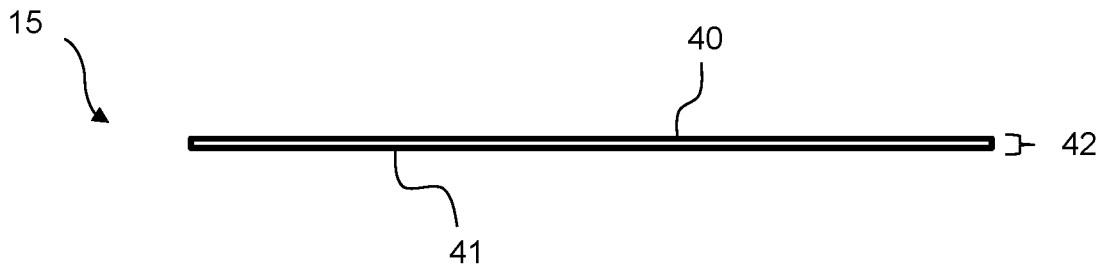
FIG. 2*c* is a side plan view of an umbrella mesh layer in accordance with some embodiments of the presently disclosed subject matter.

As shown in FIG. 2*c*, mesh layer 15 includes top face 40, opposed bottom face 41, and thickness 42. The mesh can have any desired thickness, such as about 0.001-1 inch (e.g., at least/no more than about 0.001, 0.005, 0.01, 0.05, 0.1, 0.2, 0.3, 0.4, 0.5, 0.6, 0.7, 0.8, 0.9, or 1 inch). The mesh layer can extend the full length of the umbrella canopy (e.g., beneath the entire network of shingles 10).

In some embodiments, the mesh can be constructed from any suitable material, such as (but not limited to) nylon, polyethylene, polyester, polypropylene, Teflon®, woven plastic, metal (e.g., copper, chromium, iron, nickel, titanium, tungsten), glass, silicon carbide, fiberglass, graphite, carbon fiber, or combinations thereof.

Figure 3A:
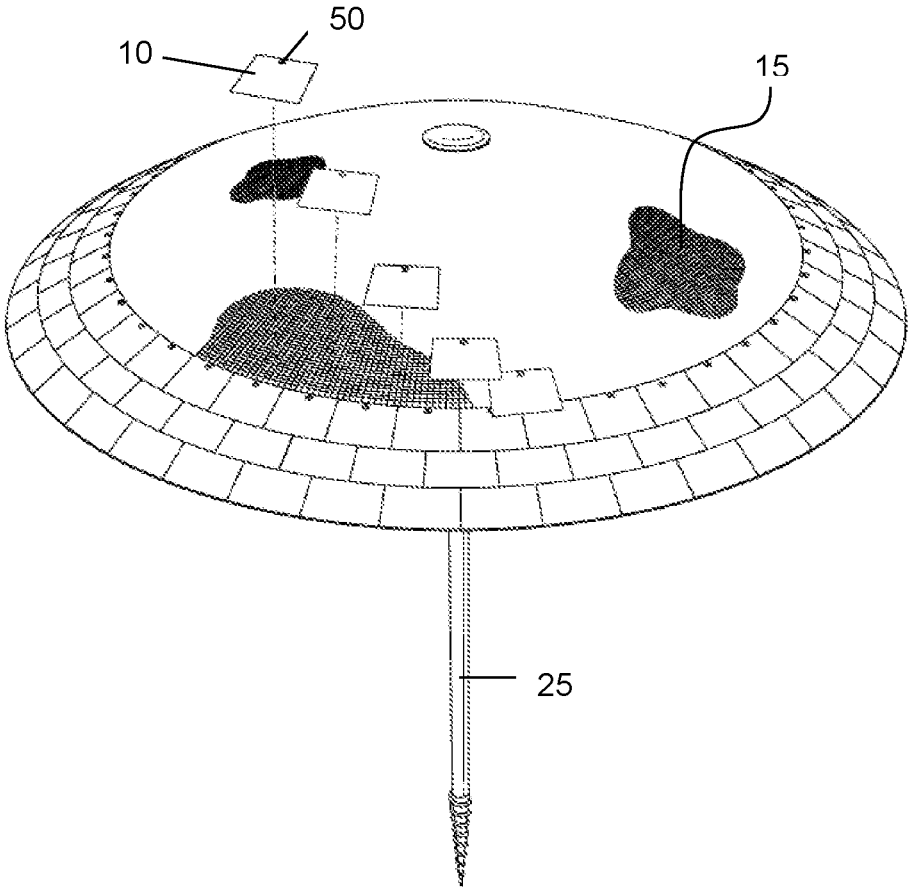
FIG. 3*a* is a perspective view of one embodiment of adding shingles to an umbrella mesh layer in accordance with some embodiments of the presently disclosed subject matter.
Figure 3B:
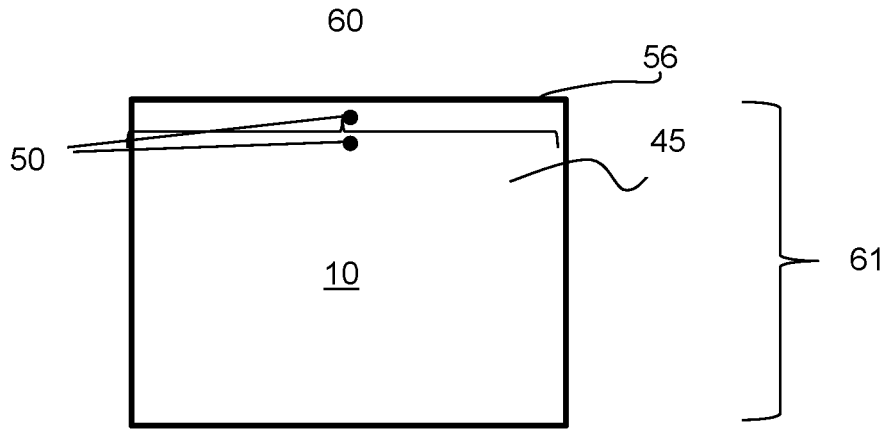
FIG. 3*b* is a top plan view of an umbrella shingle in accordance with some embodiments of the presently disclosed subject matter.
Figure 3C:
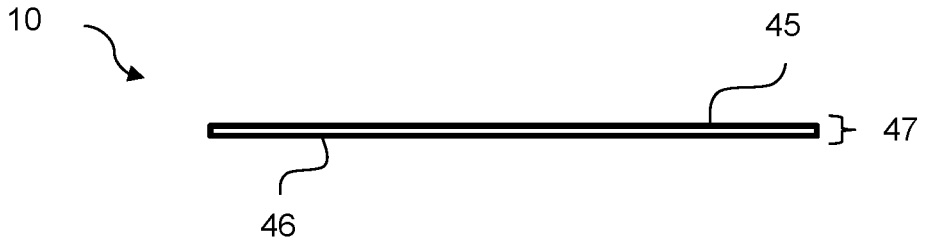
FIG. 3*c* is a side plan view of an umbrella shingle in accordance with some embodiments of the presently disclosed subject matter.

The umbrella canopy further includes an upper layer comprising a plurality of shingles 10 positioned adjacent to top face 40 of the mesh in an overlapping arrangement, as illustrated in FIG. 3*a*. The term "shingle" refers to any known type of finishing layer that can be arranged in overlapping orientations. The term "overlapping" refers to an arrangement whereby one shingle partially covers at least one other shingle. As shown in FIGS. 3*b* and 3*c*, each shingle 10 includes top face 45 and opposed bottom face 46. Each shingle further includes one or more apertures 50 that extend through the thickness of the shingle. Apertures 50 are positioned at or adjacent to top edge 57 of the shingle such the apertures are concealed when the shingle is overlapped by an adjacent shingle. The amount of overlap between shingles 10 can be selectively modified to provide greater or lesser degrees of ventilation therethrough.

Figure 4A:
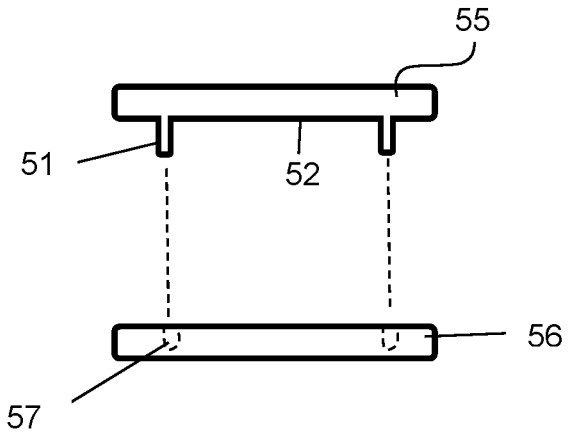
FIG. 4*a* is a top plan view of upper and lower shingle grommets in accordance with some embodiments of the presently disclosed subject matter.

Apertures 50 cooperate with upper and lower grommets 55, 56 to securely anchor the top edge of each shingle in place on the umbrella. The term "grommet" refers to a component that can be attached on either side of a shingle to maintain the shingle in proper position. As shown in FIG. 4*a*, upper grommet 55 includes a pair of arms 51 on lower face 52. The arms are configured to pass through mesh 15 and nest into two openings 57 on the top face of lower grommet 56. Each arm (and each opening) can be spaced about 0.5 inches from the adjacent arm (or adjacent opening) (e.g., at least/no more than about 0.1, 0.2, 0.3, 0.4, 0.5, 0.6, 0.7, 0.8, 0.9, or 1 inch). It should be appreciated that the grommets can include any number of arms or openings 57 (e.g., 1, 2, 3, or more). Each arm or opening can include any diameter, such as about ⅛ inch. It should be appreciated that the arm/opening arrangement is one example of retaining the upper grommet in connection with the lower grommet, and that any method can be used (e.g., press-fit arrangement, magnets, adhesive, fasteners, clips).

Figure 4B:
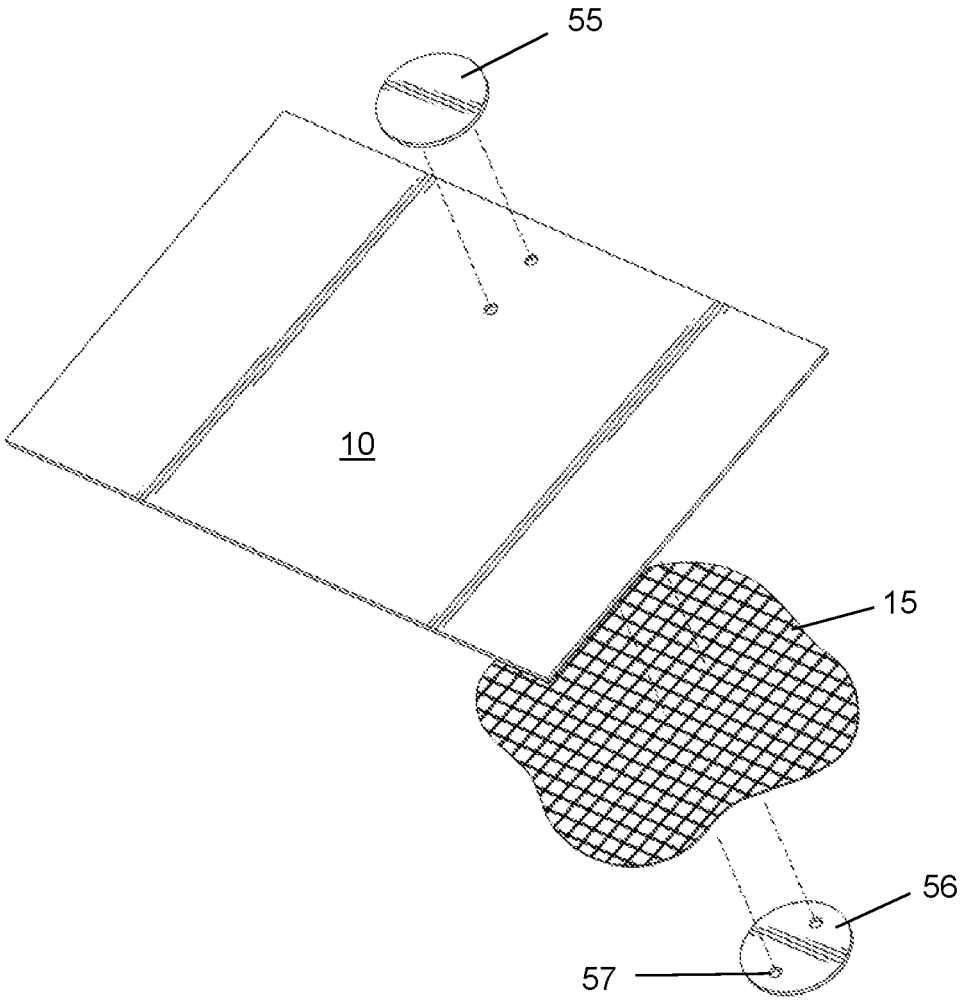
FIG. 4*b* is a perspective view of the interaction between the grommets, mesh, and umbrella shingle in accordance with some embodiments of the presently disclosed subject matter.
Figure 4C:
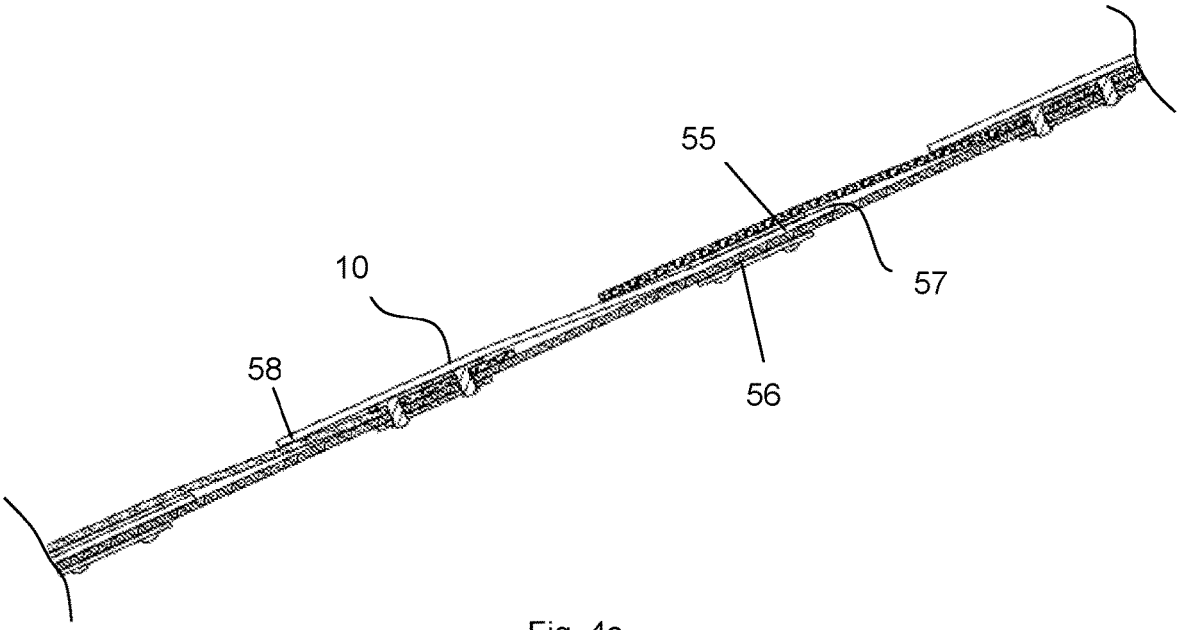
FIG. 4*c* is a side plan view of the interaction between the grommets, mesh, and umbrella shingles in accordance with some embodiments of the presently disclosed subject matter.

Thus, upper grommet 55 permanently or releasably attaches to lower grommet 56 by passing through shingle apertures 50 and mesh layer 15, as shown in FIG. 4*b*. Each lower grommet includes a pair of openings 57 configured to align with the shingle apertures. Thus, the lower grommet is positioned on mesh bottom face 41, and upper grommet 55 can be positioned on top face 45 of shingle 10, as shown in FIG. 4*c*. The grommets hold each shingle in place and keep the shingle from rotating. Advantageously, because the grommets attach to the shingles at the upper shingle edge, the lower edge of the shingle is free to move in response to wind flow, as discussed in detail below.

Figure 4D:
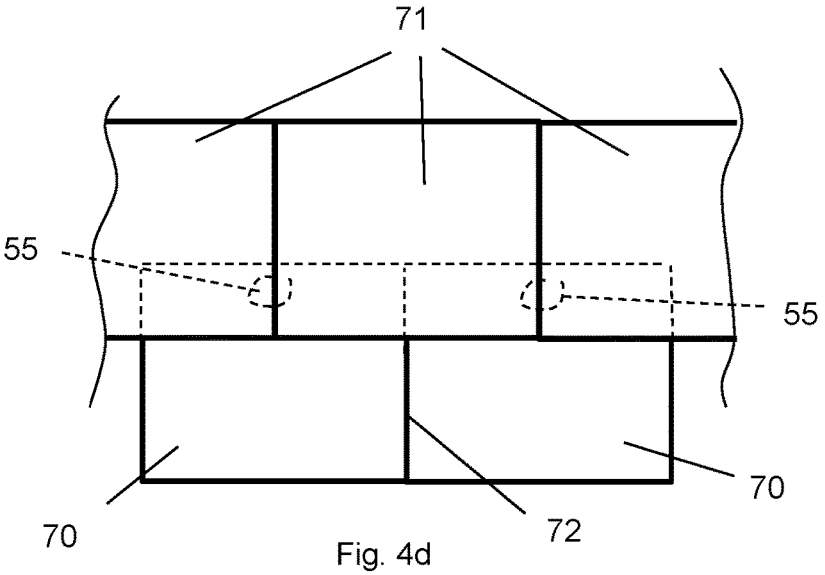
FIG. 4*d* is a top plan view of a shingle arrangement in accordance with some embodiments of the presently disclosed subject matter.

The first row of shingles 70 can be fastened beginning on the bottom edge of the mesh layer, as shown in FIG. 4*d*. The second row of shingles 71 then overlap the first row such that each second row shingle is centered over joint 72 between the first row shingles. In addition, the first row upper grommets 55 are concealed by the second row shingles, creating a pleasing and aesthetic look. Each second row shingle can overlap positioned first row shingles by about 2 inches (e.g., at least/no more than about 1, 1.5, 2, 2.5, or 3 inches) in some embodiments. Additional rows of shingles can then be fastened as set forth for the first and second rows, until the shingles fully cover the mesh layer.

Each shingle includes length 60, width 61, and thickness 62. The term "length" refers to the longest horizontal straight line distance of shingle 10. The term "width" refers to the distance perpendicular to the length. The term "thickness" refers to the distance between the top and bottom faces of the shingle. Each shingle can include length and/or width of about 3-10 inches (e.g., at least/no more than about 3. 3.5. 4. 4.5. 5. 5.5. 6. 6.5. 7. 7.5. 8. 8.5. 9. 9.5. or 10 inches). It should be appreciated that the presently disclosed subject matter is not limited and the shingle can be configured with any desired size and shape.

Shingle 10 can further be configured in any desired shape, such as (but not limited to) square, rectangular, oval, triangular, and the like, as shown in FIGS. 5*a*-5*d*. Any shape can be used.

Grommets can be constructed from any suitable material, such as (but not limited to) wood, metal, plastic, carbon fiber, fabric, and the like.

Shingles 10 can be constructed from any suitable material, such as (but not limited to) plastic, vinyl, cloth, or polyester, canvas, acrylic, polyvinyl chloride (PVC), nylon, polyester-nylon blend, marine-grade vinyl, silk, rayon, combinations thereof. In some embodiments, the shingles are constructed from a flexible material that is capable of undergoing strain, such as bending or stretching without being damaged or broken. In some embodiments, the materials used to construct shingles 10 can be waterproof (e.g., a material that prevents or impedes the entry/ingress of water). The material used to construct shingle 10 can further be easy to clean and can prevent growth of mold and mildew or sun bleaching.

The disclosed shingles are both decorative and functional. For example, shingles 10 serves to provide shade to a user and also can keep the umbrella canopy from leaking. Shingles 10 can also be configured in any suitable colors and patterns. For example, the shingles can be constructed in any suitable color or combination of colors to correspond to a desired sports team (e.g., in red and white). The colored shingles can also be positioned in any desired pattern (e.g., stripes) or to spell out words (e.g., college team names or abbreviations, phrases, names, and the like).

Umbrella 5 further includes post 25 with anchor 30 that maintains the umbrella in a support surface (e.g., sand). FIG. 6 illustrates one embodiment of post 25 comprising length 60 of about 3-6 feet or more. In some embodiments, the length of post 25 can be adjustable, such as through a telescoping arrangement. The term "telescoping" refers to a mechanical action of at least two longitudinal bodies of congruent cross-sections sliding relative to each other along a common longitudinal axis.

Post 25 can have any desired cross-sectional shape. For example, the post can be configured with a circular, oval, square, rectangular, triangular, pentagonal, hexagonal, octagonal, heart, diamond, or abstract cross-sectional shape.

Second end 61 of the post is operatively connected to anchor 30. The term "anchor" broadly refers to any element that provides weight and/or a mechanism by which to secure assembly 5 into a support surface (e.g., sand). The anchor can be permanently attached to post 25 using adhesives, welding, and the like. Alternatively, the anchor can be releasably attached to the post using any of a wide variety of mechanical elements (e.g., screw knob, clip). A releasably attached anchor allows for the replacement of the anchor depending on use conditions (e.g., beach sand versus grass or rock). In some embodiments, the anchor can include a spike, helical corkscrew, or shaft with a threaded portion capable of being turned and embedding itself into a support surface (e.g., sand at a beach). Because anchor 30 is inserted into a support surface, it does not rotate and remains in the inserted position until the user desires to remove it. Likewise, the post does not rotate in response to wind conditions due to its attachment to the anchor.

Figure 7:
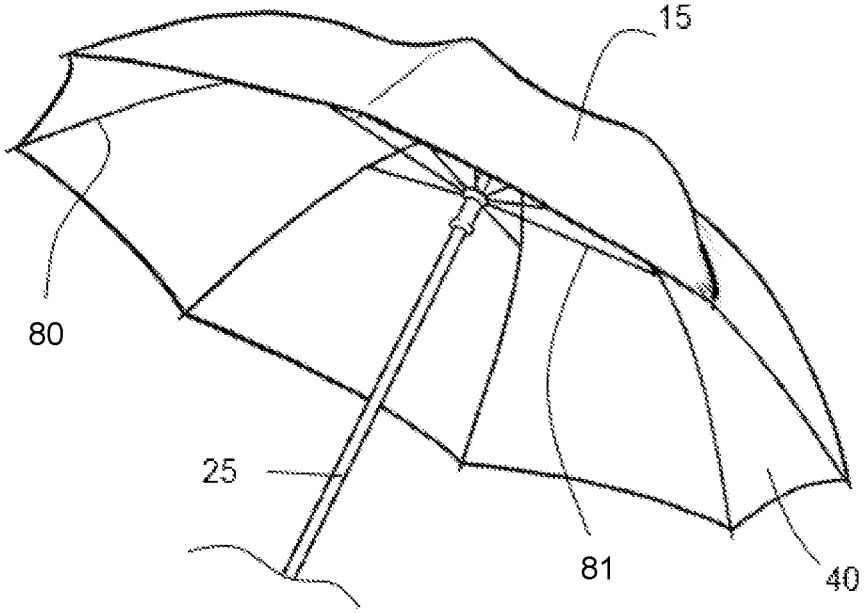
FIG. 7 is a perspective view of an umbrella frame in accordance with some embodiments of the presently disclosed subject matter.

In some embodiments, umbrella 5 can include a frame comprising a series of ribs 80 and/or cross-ribs 81 positioned on lower side 41 of mesh 15, as shown in FIG. 7. The umbrella frame functions to provide structure and shape to the umbrella, as well as support the weight of mesh 15 and shingles 10. Umbrella 5 can include any number of ribs and cross-ribs positioned in any desired configuration. In some embodiments, the ribs and/or cross-ribs are optional, and umbrella 5 can be configured without ribs or cross-ribs. Mesh 15 can be attached to the ribs and/or cross-ribs using any suitable method, such as the use of fasteners, clips, adhesive, and the like. In some embodiments, the mesh is permanently attached to the ribs and/or cross-ribs. In other embodiments, the mesh is releasably attached. The umbrella can optionally include a pulley or other opening mechanism that assists in opening and closing the umbrella canopy.

Figure 8:
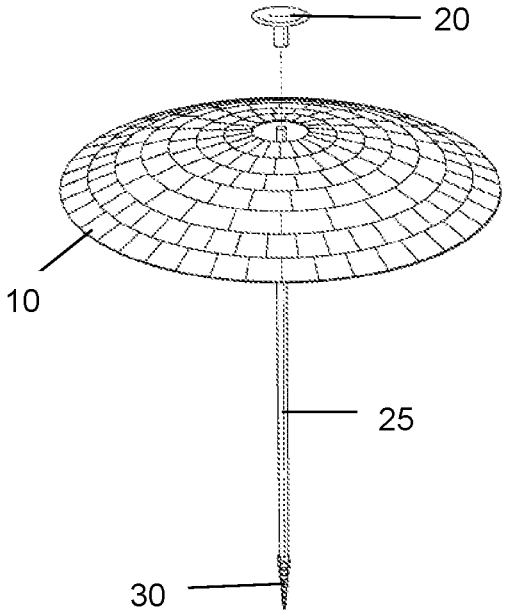
FIG. 8 is a perspective view of an umbrella top cap being inserted in accordance with some embodiments of the presently disclosed subject matter.

Cap 20 can be attached to the first end 62 of post 25 using any known method. For example, a screw, bolt, or other element can be threaded through the cap, extending into the post. Cap 20 can be configured in any desired shape and/or size (e.g., a diameter of about 6 inches in some embodiments), as shown in FIG. 8. In some embodiments, the cap can be constructed from any suitable material, such as wood, plastic, metal, carbon fiber, and the like. In some embodiments, the material used to construct cap 20 can be UV-resistant.

Figure 9:
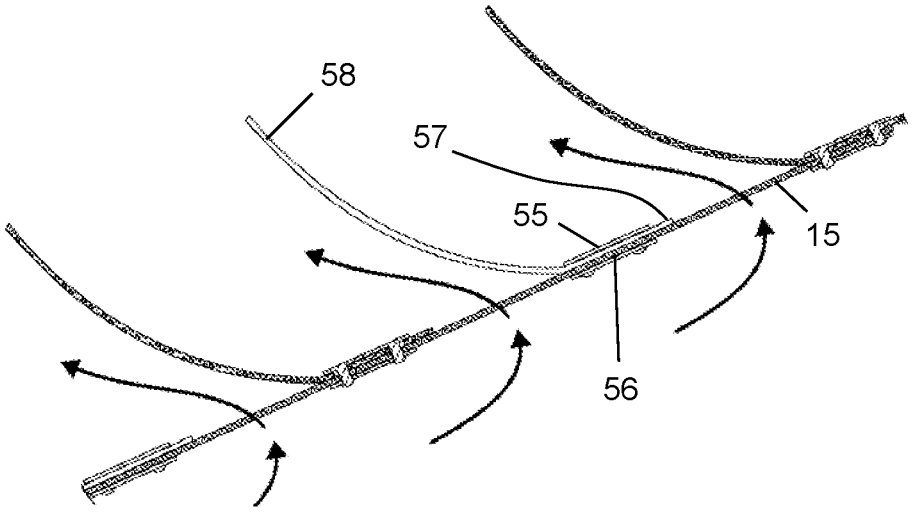
FIG. 9 is a schematic indicating wind passing from underneath the umbrella, through the mesh layer, and through the shingles in accordance with some embodiments of the presently disclosed subject matter.

In use, the disclosed umbrella can be used to provide shade safely and securely to one or more users. Anchor 30 can be positioned in a support surface, such as sand at the beach. In some embodiments, the post can be manually rotated to insert the anchor into the ground. Once the umbrella has been securely positioned in the ground, users can relax under the shade provided by the shingles. Even on windy days, the wind passes over and between the shingles, thereby preventing the umbrella from becoming dislodged from the ground, as illustrated in FIG. 9. Thus, the wind can travel through mesh 15, lifting second end 58 of shingles 10 (the end opposite to where the grommets are positioned). The lifting of the second shingle end provides a path for the wind to escape the canopy. In this way, the breeze (represented by the arrows) easily passes over and through the umbrella canopy instead of uprooting the umbrella as is common with conventional umbrellas. The flexibility of the second shingle ends in response to the wind permits air to be vented across and through the canopy. In addition, the breeze flowing through the canopy provides an additional ventilation effect for the user, eliminating the hot air beneath the umbrella. Thus, umbrella 5 can effectively prevent dislodgment from an anchoring location by allowing wind to freely flow through the mesh layer and the one or more spaces created by the lifting of the second shingle ends.

The disclosed assembly therefore offers many advantages over prior art umbrellas. For example, umbrella 5 provides for increased wind flow through mesh 15 and between the shingles. In this way, uprooting of the umbrella is avoided. As a result, the umbrella stays in the original position until desired by the user, thereby preventing breakage, damage to the umbrella, and/or injury to beachgoers.

Umbrella 5 is easy to use and can be enjoyed by a wide variety of users, from children to the elderly.

The disclosed umbrella is windproof, and therefore will not launch into the air as a projectile on windy days due to the provided air flow through the mesh and between the shingles.

Umbrella 5 can be configured in any suitable shape and/or size, such as conventional round umbrellas as well as square, rectangular, and other shaped designs. In addition, the umbrella can be configured for a single user or sized for multiple users.

The disclosed umbrella comprises a single post, so it is universally permitted on beaches where tents are not.

Umbrella 5 is configured to be lightweight in construction and easily movable to a desired location.

Umbrella 5 is capable of withstanding a variety of weather conditions, including wind resistance.

The canopy of the disclosed umbrella is capable of being made with a variety of shingle sizes.

The disclosed umbrella can be capable of withstanding winds in excess of 10, 20, 30, 40, 50 or more miles per hour. Traditional umbrellas composed of frames made of metal or wood, will fail when subjected to similar wind conditions.

As described above, although a preferred embodiment of the present invention has been described for illustrative purposes, those skilled in the art will appreciate that various modifications, additions, and substitutions are possible, without departing from the scope and spirit of the invention as disclosed in the accompanying claims.

What is claimed is:

1. A wind-resistant umbrella defined by:

a vertical support pole;

a canopy attached to an upper end of the support pole, wherein the canopy comprises:

a lower mesh layer defined by an upper surface and an opposed lower surface;

an upper layer comprising a plurality of shingles, wherein each shingle is defined by an upper surface, an opposed lower surface positioned adjacent to the mesh layer upper surface, and one or more apertures positioned adjacent to a top shingle edge;

a plurality of upper grommets, each upper grommet comprising a lower surface defined by one or more arms that extend away from the lower surface, wherein the lower surface of each upper grommet is positioned adjacent to the upper surface of a shingle and wherein the one or more upper grommet arms extend through the one or more shingle apertures;

a plurality of lower grommets, each lower grommet comprising a top surface and an opposed bottom surface, and one or more openings sized and shaped to accept the one or more arms to join a corresponding upper grommet to the lower grommet, wherein the top surface of each lower grommet is posited adjacent to the mesh layer lower surface;

wherein the top edge of each shingle is adhered in position on the umbrella through the upper and lower grommets; and a bottom edge of each shingle is non-adhered to the umbrella and freely moves in an upward direction in response to air currents.

2. The wind-resistant umbrella of claim 1, wherein the shingles are arranged in the upper layer in an overlapped configuration whereby one shingle partially covers at least one other shingle.

3. The wind-resistant umbrella of claim 1, further comprising a top cap positioned at the top end of the support pole, above the shingles.

4. The wind-resistant umbrella of claim 1, wherein each shingle comprises two apertures positioned at the top edge of the shingle.

5. The wind-resistant umbrella of claim 1, wherein each arm releasably attaches to a corresponding opening.

6. The wind-resistant umbrella of claim 1, wherein each shingle has a length, width, or both of about 3-10 inches.

7. The wind-resistant umbrella of claim 1, wherein the shingles are constructed from a flexible material.

8. The wind-resistant umbrella of claim 1, wherein shingles are constructed from one or more waterproof materials.

9. The wind-resistant umbrella of claim 1, further comprising an anchor positioned at a second end of the support pole.

10. The wind-resistant umbrella of claim 1, further comprising a support frame positioned below the mesh layer.

11. The wind-resistant umbrella of claim 10, wherein the frame is defined by a plurality of ribs, cross-ribs, or both.

12. The wind-resistant umbrella of claim 1, further comprising an anchor positioned at a second end of the support pole.

13. A method of precluding dislodgment of a wind-resistant umbrella from an anchoring location, the method comprising:

positioning a wind-resistant umbrella in the anchoring location, the wind-resistant umbrella defined as:

a vertical support pole;

a canopy attached to an upper end of the support pole, wherein the canopy comprises:

a lower mesh layer defined by an upper surface and an opposed lower surface;

an upper layer comprising a plurality of shingles, wherein each shingle is defined by an upper surface, an opposed lower surface positioned adjacent to the mesh layer upper surface, and one or more apertures positioned adjacent to a top shingle edge;

a plurality of upper grommets, each upper grommet comprising a lower surface defined by one or more arms that extend away from the lower surface, wherein the lower surface of each upper grommet is positioned adjacent to the upper surface of a shingle and wherein the one or more upper grommet arms extend through the one or more shingle apertures;

a plurality of lower grommets, each lower grommet comprising a top surface and an opposed bottom surface, and one or more openings sized and shaped to accept the one or more arms to join a corresponding upper grommet to the lower grommet, wherein the top surface of each lower grommet is posited adjacent to the mesh layer lower surface;

wherein the top edge of each shingle is adhered in position on the umbrella through the upper and lower grommets; and a bottom edge of each shingle is non-adhered to the umbrella and freely moves in an upward direction in response to air currents;

exposing the wind-resistant umbrella to windy conditions, such that air freely flows from the lower side of the mesh layer, through the mesh layer, to push against the bottom edge of one or more shingles, thereby moving the bottom shingle edges to create an exit for the air;

wherein the wind-resistant umbrella is precluded from dislodging from the anchoring location.

14. The method of claim 13, wherein the bottom edge of the shingles returns to contact the mesh layer when the air flow is removed.

15. The method of claim 13, wherein the shingles are arranged in the upper layer in an overlapped configuration whereby one shingle partially covers at least one other shingle.

16. The method of claim 13, wherein each shingle comprises two apertures positioned at the top edge of the shingle.

17. The method of claim 13, wherein each arm releasably attaches to a corresponding opening.

18. The method of claim 13, wherein each shingle has a length, width, or both of about 3-10 inches.

19. The method of claim 13, wherein the shingles are constructed from a flexible material.

20. The method of claim 13, wherein shingles are constructed from one or more waterproof materials.

* * * * *